US006354182B1

(12) United States Patent
Milanovich

(10) Patent No.: US 6,354,182 B1
(45) Date of Patent: Mar. 12, 2002

(54) LAUNCH ASSIST SYSTEM

(76) Inventor: Philip J. Milanovich, 1550 Harrison Ave., Butte, MT (US) 59701

( * ) Notice: Subject to any disclaimer, the term of this patent is extended or adjusted under 35 U.S.C. 154(b) by 0 days.

(21) Appl. No.: 09/551,490

(22) Filed: Apr. 18, 2000

(51) Int. Cl.[7] ..... F41F 3/04
(52) U.S. Cl. ..... 89/1.818; 244/63; 124/17
(58) Field of Search ..... 89/1.818, 1.81, 89/1.8; 244/63; 124/17, 21

(56) References Cited

U.S. PATENT DOCUMENTS

| | | | | |
|---|---|---|---|---|
| 3,053,479 A | * | 9/1962 | Siegel et al. | 244/14 |
| 3,088,698 A | * | 5/1963 | Ongaro | 244/63 |
| 3,158,062 A | | 11/1964 | Feiler | 89/1.7 |
| 3,160,062 A | | 12/1964 | Moy et al. | 89/1.7 |
| 3,363,508 A | | 1/1968 | Stahmer | 89/1.818 |
| 3,548,708 A | | 12/1970 | Hubigh | 89/1.818 |
| 3,631,803 A | | 1/1972 | Davis | 102/70 |
| 4,040,334 A | | 8/1977 | Smethers et al. | 89/1.804 |
| 4,223,472 A | | 9/1980 | Fekete et al. | 46/44 |
| 4,426,909 A | | 1/1984 | Carter | 89/1.816 |
| 4,671,163 A | | 6/1987 | Erikson | 89/1.81 |
| 4,944,210 A | | 7/1990 | Flock | 89/1.818 |
| 5,052,272 A | | 10/1991 | Lee | 89/7 |
| 5,279,199 A | | 1/1994 | August | 89/1.51 |
| 5,333,528 A | | 8/1994 | Klestadt et al. | 89/1.51 |

* cited by examiner

*Primary Examiner*—Michael J. Carone
*Assistant Examiner*—Michelle Thomson
(74) *Attorney, Agent, or Firm*—Cahill, Sutton & Thomas, P.L.C.

(57) ABSTRACT

A launch assist system for supplementing the launch acceleration forces of a projectile, rocket or missile. An airtight chamber covered by a flexible elastic membrane supports a platform in the center of the membrane; the platform is electromagnetically coupled to a cocking mechanism that withdraws the platform into the chamber. Air within the chamber is removed and compressed to be stored in a holding tank as the platform is lowered into the chamber and as the flexible elastic membrane extends into the chamber. The electromagnetic coupling may be triggered to release the platform to permit the stored energy in the extended flexible elastic membrane, and in supplemental force members, to apply acceleration forces to a launch vehicle; the compressed air stored in the tank is simultaneously released to fill the chamber as the flexible elastic membrane is withdrawn.

9 Claims, 2 Drawing Sheets

LAUNCH ASSIST SYSTEM

FIELD OF THE INVENTION

The present invention relates to the launching of a projectile, rocket or missile, and more particularly to a system to assist in such launch to lessen the necessary fuel load during the initial phases of the launch.

BACKGROUND OF THE INVENTION

The launching of projectiles, rockets or missiles usually entails the ignition or firing of a propellant creating a thrust to raise the launch vehicle as it overcomes the forces of gravity. This initial phase requires that the vehicle move from rest and is accelerated to a critical velocity to permit the effective operation of internal controls to stabilize the vehicle as it continues to accelerate. The fuel expended during this initial acceleration requires that the acceleration forces exceed the weight of the vehicle including the onboard fuel; a reduction in weight of the vehicle lessens the required acceleration force and thus the fuel required to create the force. However, fuel calculations are predicated on the total weight of the vehicle including all unused fuel onboard.

Therefore, a reduction in the fuel load will reduce the requirement for onboard fuel since the total weight of the vehicle before launch has been lowered. If a supplemental acceleration system could be employed to impart acceleration forces to the vehicle, during the initial phases of its launch, the onboard fuel requirements would be lowered and the overall fuel requirements for the launch would be reduced.

OBJECTS OF THE INVENTION

It is therefore an object of the present invention to provide a system for assisting the initial phases of the launch of a launch vehicle such as a projectile, rocket or missile.

It is another object of the present invention to provide a system to impart supplemental acceleration forces to a vehicle during launch.

It is still another object of the present invention to provide a system for supplementing the required thrust or force to create acceleration to launch a vehicle without the use of onboard fuel.

It is still another object of the present invention to provide a launch assisting system to impart an acceleration force to a launch vehicle to supplement the acceleration forces being created by the thrust of the onboard propulsion system.

These and other objects of the present invention will become apparent to those skilled in the art as the description thereof proceeds.

SUMMARY OF THE INVENTION

Briefly, in accordance with one embodiment of the present invention, an airtight chamber is provided having a flexible elastic membrane extending across the open top thereof with a supporting platform positioned at the top center of the chamber. A cocking mechanism is secured to the platform for withdrawing the platform into the chamber thereby stretching the flexible elastic membrane. As the platform is being withdrawn into the airtight chamber, a compressor withdraws air from the chamber and stores the compressed air in a holding tank. Thus, as the cocking mechanism withdraws the platform, the flexible elastic membrane stretches and the air in the chamber is removed and stored in a compressed form in a holding tank. A launch vehicle mounted on the platform is thus lowered into the chamber as the platform is withdrawn. Supplemental force members such as steel cables may also be secured to the platform above the flexible elastic membrane and be lowered with the platform against tension forces applied to the supplemental force members.

At a predetermined time and position within the chamber, the electromagnetic coupling holding the platform in its depressed position within the chamber is de-energized thus releasing the platform and permitting the force of the flexible elastic membrane, and forces supplied by supplemental force members, to apply accelerating forces to the launch vehicle mounted on the platform. Simultaneously, the compressed air previously stored in a holding tank is released into the chamber to provide a positive pressure in the chamber; the positive pressure creates an upward force on the flexible membrane and the platform mounted thereon. Thus, the expanding air contributes ti the force applied the launch vehicle.

BRIEF DESCRIPTION OF THE DRAWINGS

The present invention may more readily be described by reference to the accompanying drawings in which.

DESCRIPTION OF THE PREFERRED EMBODIMENT

Figure 1:
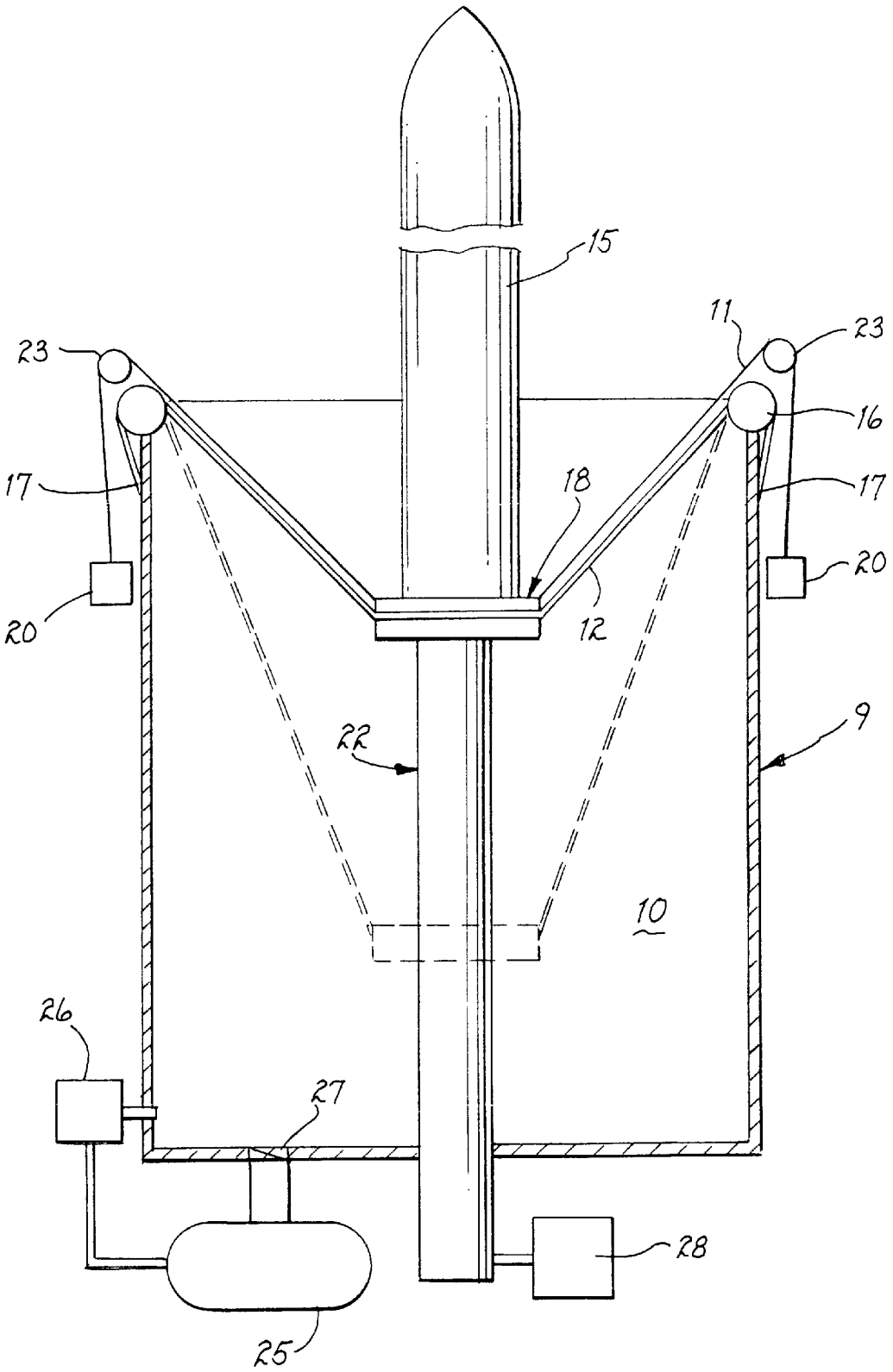
FIG. 1 is an illustration, partly schematic and partly in section, of a launch assist system constructed in accordance with the teachings of the present invention.

Referring to FIG. 1, a launch structure 9 comprising a cylindrical rigid member forms a chamber 10. A flexible elastic membrane 12 extends across the chamber and supports a launch platform 18 in the center thereof.

The flexible elastic membrane 12 may comprise any of numerous available flexible elastic materials having a suitable modulus of elasticity and that may be either monolithically molded or formed such as by weaving; the membrane must be capable of stretching and returning essentially to its original shape upon release of the forces creating the deformation of the material. It is intended that the flexible elastic membrane will be stretched and will be utilized upon release to impart an accelerating force to a launch vehicle. The flexible elastic membrane 12, attached to platform 18, extends over a plurality of guide drums 16 positioned about the upper circumference of the launch structure 9 and is anchored at 17. Thus, as the flexible elastic membrane is stretched by the lowering of the platform 18 into the chamber 10, the guide drums 16 permit the material of the membrane to flow over the drum while the anchors 17 secure the periphery of the membrane to the launch structure 9. It will be appreciated that FIG. 1 is a two dimensional representation of a three dimensional system; that is, guide drums 16 will normally be positioned about the periphery of the opening of the launch structure 9 such that the lowering of the membrane into the chamber 10 can be accommodated without damaging or frictional contact of the membrane with the launch structure 9.

A launch vehicle 15 is mounted on the launch platform 18; the platform is electromagnetically coupled to a cocking mechanism 22. The cocking mechanism 22 (to be described) may be a screw-threaded shaft which can be lowered by a screw drive mechanism so that it extends through the bottom of launch structure 9 as it is lowered; alternatively, and in a preferred form, the cocking mechanism comprises a hydraulic ram that is driven by a drive 28 in the form of hydraulic pumps. With either embodiment, the cocking mechanism is lowered to thus lower the platform 18 into the chamber 10.

Supplemental force members 11 may take the form of steel linked chains or steel cables extending radially from the platform 18. These are strong enough (sufficient tensile strength) to withstand forces applied thereto by a supplemental energy source such as hydraulic rams, solenoids, or mechanical energy storage means such as springs. The supplemental energy sources are shown schematically as tensioning means 22. The strengthening members may separately be secured to platform 18 over appropriate guide pulleys 23 and may either be formed as a supplemental force member positioned on top of the flexible elastic membrane as shown in FIG. 1 or may actually be formed as part of the membrane 12 (e.g. woven into a supporting fabric that is impregnated with an air impermeable material such as rubber). The flexible elastic membrane, with or without the supplemental force members, provides an air tight seal with the chamber 10. As the cocking mechanism 22 lowers the platform 18 into the chamber 10, compressor 26 removes the air from the chamber 10 and compresses the air to be stored in the holding tank 25.

At launch time, the electromagnetic coupling holding the platform 18 in its lowered position (shown in dashed lines in FIG. 1) is deactivated to permit the stored energy in the stretched flexible elastic membrane, and the stored energy available in any supplemental force members, to impart an acceleration force to the launch vehicle 15. Normally, this force will be applied at time coinciding with or near the time of ignition of the fuel onboard the typical launch vehicle. Simultaneously, as the forces applied to the platform tend to direct the platform upwardly, valve 27 is opened to permit the compressed air in holding tank 25 to enter the chamber 10; the air being replaced in chamber 10 creates a temporary high pressure below the membrane, thus assisting in the creation of additional upward forces to assist the launch.

Figure 2:
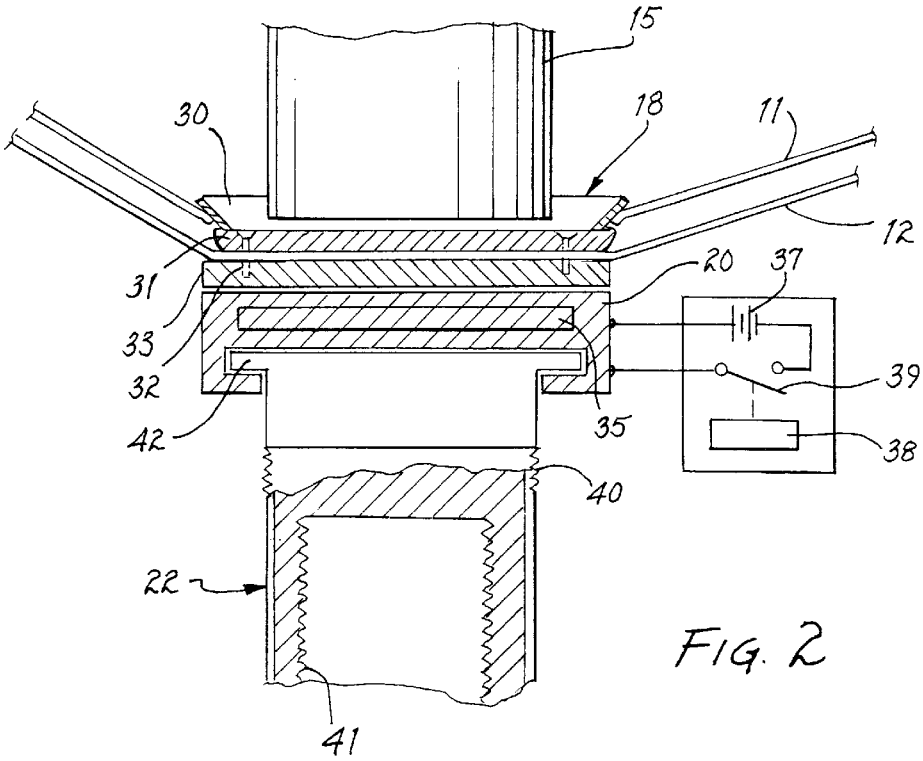
FIG. 2 is an enlarged view, partly in section, of the details of the launch platform.

Referring to FIG. 2, the launch platform 18 is shown in greater detail. The platform may comprise a support plate 31 and thrust deflector plate 30 for supporting the launch vehicle. The deflector plate is secured to the support plate 31 in any convenient manner and may be provided to assist in deflecting the escaping gases from the ignition of the fuel onboard the vehicle 15 during the initial phases of the launch. Supplemental force members 11 may be secured to the launch platform in any convenient mainer; in the embodiment shown in FIG. 2 these force members are secured to the support plate 31 through the thrust deflector 30. The flexible elastic membrane 12 is secured to the launch platform in any convenient manner; in the embodiment chosen for illustration, the membrane 12 is compressed between the support plate 31 and a trigger plate 33. The support plate 31 and trigger plate 33 are shown secured to each other through the utilization of fastening means 32 such as machine screws or the like. Any fastening technique may be used; however, it is important that the fastening, including the use of bolts or screws, does not adversely affect the integrity of the airtight chamber 10. That is, the fastening means 32 are shown extending through the flexible elastic membrane 12; it is important that this penetration of the membrane be sealed to maintain the membrane as an airtight member. An electromagnet 20 having an electromagnetic coil 35 (shown schematically) therein is coupled to the platform 18 by applying a suitable electrical current to the coil 35. The current supplied to the coil provides sufficient electromagnetic attraction to maintain contact with the trigger plate 33 until the electromagnetic field created by the current flowing in the coil 35 ceases. The control of the coil current is provided by a triggering system schematically shown in FIG. 2 at 36. A power source such as a battery 37 applies a suitable potential to create an electric current for the coil 35 through a switch 39. This switch is opened or closed in accordance with the commands provided by a switch controller 38. It will be apparent to those skilled in the art that the schematic representation in FIG. 2 is provided for convenience and that actual utilization of the control circuit is likely to be substantially more complex and would be interfaced with the overall launch control system that effects ignition of the launch vehicle powering system.

The cocking mechanism 22 may be coupled to the electromagnet 20 in any convenient manner; if the cocking mechanism 22 is a screw-activated rotating member with external threads 40, then a locking flange 43 would be appropriate to permit the cocking mechanism to rotate with respect to the electromagnet 20. If, however, the cocking mechanism is a hydraulic ram, or if the cocking mechanism incorporates internal threads 41, or any other means wherein the cocking mechanism 22 is not required to rotate, then the locking flange 43 may be replaced with any means of rigidly attaching the mechanism to the electromagnet 20 without provision for relative rotation. The launch platform 18 and the many components described in connection with FIG. 2 may take many forms; however, the use of an electromagnetic triggering mechanism appears to be the most convenient and the most readily controllable.

Figure 3:
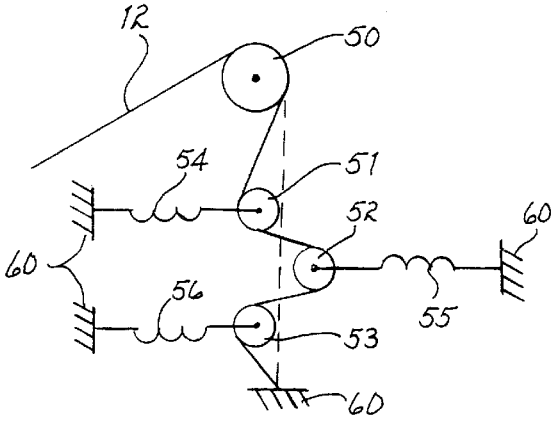
FIG. 3 is a schematic illustration of a flexible elastic membrane take up system that may be used in the system of the present invention.

The flexible elastic membrane will "stretch" as the cocking mechanism withdraws the platform 18 into the chamber 10. Depending on the physical size and weight of the launch vehicle, the vehicle may require extension into the chamber 10 to an extent greater than the elasticity of the membrane material will permit. That is, the material may be stretched beyond its ability to return to its original shape or perhaps beyond its tensile strength. To accommodate these variations in the size or total length of the flexible elastic membrane as it extends from the exterior of the chamber 10 (where it is attached to the launch structure 9) to the platform 18 at its lowest position during the lowering of the platform into the chamber, takeup drums are provided. Referring to FIG. 3, the flexible elastic membrane 12 is shown passing over a drum 50. The drum 50 corresponds to the guide drum 16 shown in FIG. 1. In FIG. 3, the amount of material used in the flexible elastic membrane 12 requires a means to accommodate the excess material when the membrane is in its relaxed or upper-most position; that is, with or without a launch vehicle, but in an uncocked position. Accordingly, drums 51, 52 and 53 are provided to permit the flexible elastic membrane to pass over the respective drums in a serpentine fashion. Each of the drums is spring loaded such as by springs 54, 55 and 56, respectively, which are anchored as shown at 60. The position shown in FIG. 3 for the membrane 12 is the position that the membrane would take in an uncocked position. When the membrane is stretched during the lowering of the platform into the chamber 10, the membrane extends from the anchor 60 in a straight line as indicated by the broken line of FIG. 3 to the drum 50. Each of the drums 51, 52 and 53 would thus be moved against the force of their respective springs to accommodate the straightened path of the flexible elastic membrane 12. As the launch proceeds, and the membrane returns to its unstretched condition, the respective springs force the connected drums to return to the position shown in FIG. 3 to thus create a serpentine path for the flexible elastic membrane 12 to accommodate its longer unstretched form.

Figure 4:
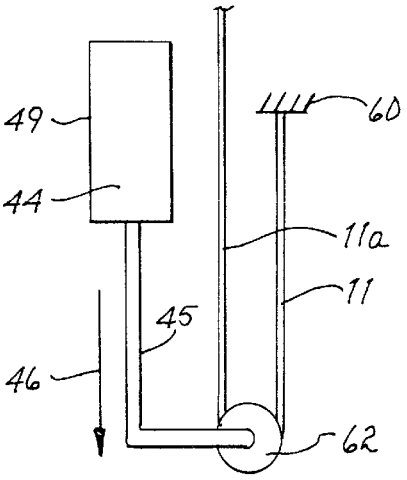
FIG. 4 is a schematic illustration of a tensioning means for supplemental force members.

The supplemental force members 11 may be secured to the platform 18 as described in connection with FIGS. 1 and 2. These supplemental force members may be necessary in those instances where the forces supplied by the flexible elastic membrane are insufficient to materially affect the launch assist. These supplemental force members 11 may take the form of cables, steel link chains, composition cords or ropes and the like. These members may be positioned separately such as shown in FIG. 1 or may in some instances be positioned within the chamber 10 beneath the flexible elastic membrane 12. It may also be possible to incorporate supplemental force members directly in the fabric of the flexible elastic membrane although accommodating the different moduli of elasticity of the membrane and supplemental force members may complicate such an embodiment. The force supplied by the supplemental force members 11 may be derived from any suitable tensioning means such as those shown schematically in FIG. 4. Referring to FIG. 4, the tensioning means 49 may comprise a force cylinder 44 in the form of a hydraulic cylinder, an electromagnetic coil, or a mechanical spring. The force provided by hydraulic pressure, or the energization of an electromagnetic coil, or the release of the energy stored in a mechanical spring acts upon a piston 45 to drive the piston in the direction indicated by the arrow 46. The supplemental force member 11 is anchored as shown at 60 to a stationary entity such as the launch structure 9. The driving of the piston 45 in the direction of the arrow 46 will apply a tensile force to the member 11 and withdraw that portion for the supplemental force member 11*a* downwardly as shown in FIG. 4. The force member 11 passes over a guide pulley 62 which in effect doubles the speed of withdrawal of the supplemental force member 11 in relation to the speed of the piston 45. Other arrangements could be made to multiply the force applied by the piston 45 or adjust the speed of withdrawal of the supplemental force member to correspond to the desired speed of the platform 18 as it is accelerated upwardly from the chamber 10.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A launch assist system comprising:

(a) a launch structure having an airtight chamber and an open top;

(b) a flexible membrane extending across said open top;

(c) a launch platform supported by said membrane for mounting a vehicle thereon to be launched;

(d) a cocking mechanism positioned in said chamber and electromagnetically coupled to said launch platform to permit said platform to be lowered into said chamber and stretch said flexible membrane;

(e) a triggering system for uncoupling said cocking mechanism from said launch platform to permit the flexible membrane to return to an unstretched state; and whereby said launch platform moves upwardly and imparts an acceleration force to a vehicle mounted thereon.

2. The combination set forth in claim 1 wherein said triggering system comprises an electric circuit having a power source for supplying current to an electromagnetic coil and a switch for opening said circuit.

3. The combination set forth in claim 1 wherein said cocking mechanism is a hydraulic ram.

4. The combination set forth in claim 1 wherein said cocking mechanism is a screw drive.

5. A launch assist system comprising:

(a) a launch structure having an airtight chamber and an open top;

(b) a flexible membrane extending across said open top;

(c) a launch platform supported by said membrane for mounting a vehicle thereon to be launched;

(d) a cocking mechanism positioned in said chamber and electromagnetically coupled to said launch platform to permit said platform to be lowered into said chamber and stretch said flexible membrane;

(e) a compressor communicating with said chamber for removing air therefrom as said launch platform is lowered into said chamber;

(f) a holding tank for receiving and storing compressed air from said compressor and for admitting said compressed air into said chamber;

(g) a plurality of supplemental force members secured to said launch platform;

(h) tensioning means operatively contacting said force members for applying tensile forces thereto to impart an upward acceleration to said launch platform;

(i) a triggering system for uncoupling said cocking mechanism from said launch platform to permit the flexible membrane to return to an unstretched state and permit said compressed air to enter said chamber; and (h) whereby said launch platform moves upwardly and imparts an acceleration force to a vehicle mounted thereon.

6. The combination set forth in claim 5 wherein said triggering system comprises an electric circuit having a power source for supplying current to an electromagnetic coil and a switch for opening said circuit.

7. The combination set forth in claim 5 wherein said cocking mechanism is a hydraulic ram.

8. The combination set forth in claim 5 wherein said cocking mechanism is a screw drive.

9. A launch assist system comprising:

(a) a launch structure having an airtight chamber and an open top;

(b) a flexible membrane extending across said open top;

(c) a launch platform supported by said membrane for mounting a vehicle thereon to be launched;

(d) a cocking mechanism positioned in said chamber and electromagnetically coupled to said launch platform to permit said platform to be lowered into said chamber and stretch said flexible membrane;

(e) a triggering means system for uncoupling said cocking mechanism from said latch platform to permit the flexible membrane to return to an unstretched state;

(f) a plurality of supplemental force members secured to said launch platform;

(g) tensioning means operatively contacting said force members for applying tensile forces thereto to impart an upward acceleration to said launch platform; and whereby said launch platform moves upwardly and imparts an acceleration force to a vehicle mounted thereon.

* * * * *